US006220297B1

(12) United States Patent
Marty et al.

(10) Patent No.: US 6,220,297 B1
(45) Date of Patent: Apr. 24, 2001

(54) PULL-OUT SPRAY HEAD HAVING REDUCED PLAY

(75) Inventors: Garry Marty, Fishers; Otto Almendinger, Noblesville, both of IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 09/379,071

(22) Filed: Aug. 23, 1999

(51) Int. Cl.[7] ..... E03C 1/04
(52) U.S. Cl. ..... 137/801; 4/678; 239/588
(58) Field of Search ..... 4/678; 137/801; 239/588

(56) References Cited

U.S. PATENT DOCUMENTS 2,200,503 * 5/1940 Judell et al. ..... 239/588 X
4,761,839 * 8/1988 Ganaway ..... 4/678 X
5,090,062 * 2/1992 Hochstrasser ..... 137/801 X
5,158,234 * 10/1992 Magnenat et al. ..... 239/588 X
5,213,268 * 5/1993 Ganuert et al. ..... 239/588 X
5,361,431 * 11/1994 Freier et al. ..... 4/678 X
5,575,424 * 11/1996 Fleishmann ..... 239/588 X
5,655,750 * 8/1997 Smock et al. ..... 251/148
5,934,325 * 8/1999 Brattoli et al. ..... 137/801

* cited by examiner

*Primary Examiner*—Gerald A. Michalsky
(74) *Attorney, Agent, or Firm*—Myron B. Kapustij; Lloyd D. Doigan

(57) ABSTRACT

In a pull-out spray head faucet an annular elastomeric bushing disposed in a groove in a portion of the adapter extending rearwardly outside of the handle section of the pull-out spray head. The elastomeric bushing has a plurality of axially extending circumferentially spaced apart raised ribs on its outer surface which frictionally engage the inner surface of the spout to reduce the play and wobble of the spray head when it is inserted into the spout.

5 Claims, 4 Drawing Sheets

PULL-OUT SPRAY HEAD HAVING REDUCED PLAY

FIELD OF THE INVENTION

The instant invention relates to faucets having pull-out spray heads or wands, particularly to faucets having pull-out spray heads wherein the pull-out spray heads are securely and firmly seated in the spout or hub with reduced play or wobble.

BACKGROUND OF THE INVENTION

Faucets having pull-out spray heads are well known. The use of kitchen and lavatory faucets with pull-out spray heads has become more widespread. In these faucets the pull-out spray heads or wands are normally seated in the spout or hub of the faucet. Generally, an adapter which is mounted in and extends rearwardly for a short distance out of the handle of the wand is inserted into the hub. The adapter receives the hose and, unless it is formed to be sized just right, it generally does not fit perfectly and tightly into the hub. This results in there being some vertical play or wobble in the adapter and in the wand in which it is disposed. Also, the wand does not fit flush into the hub, and there is an unsightly space between the wand and the hub at the top of the junction of the hub and wand. The present invention remedies this problem by providing a bushing which is mounted on the adapter and allows the adapter to fit securely and snuggly into the spout reducing the play and wobble.

SUMMARY OF THE INVENTION

According to the present invention a bushing is provided on the adapter which is mounted in the wand to keep the wand from wobbling vertically when the wand of a pull-out spray head faucet is seated in the hub. The bushing is comprised of an elastomeric material such as rubber and is disposed in a groove extending around the outer circumference of the adapter. The bushing is generally annular shaped with a plurality of axially extending ribs which are circumferentially spaced apart from each other on the outer side or surface of the bushing. When the adapter is inserted into the hub, the ribs come in contact with the interior surface of the hub, and firmly and tightly hold the wand in place, thereby greatly reducing play and wobble.

DESCRIPTION OF THE PREFERRED EMBODIMENT

Figure 1:
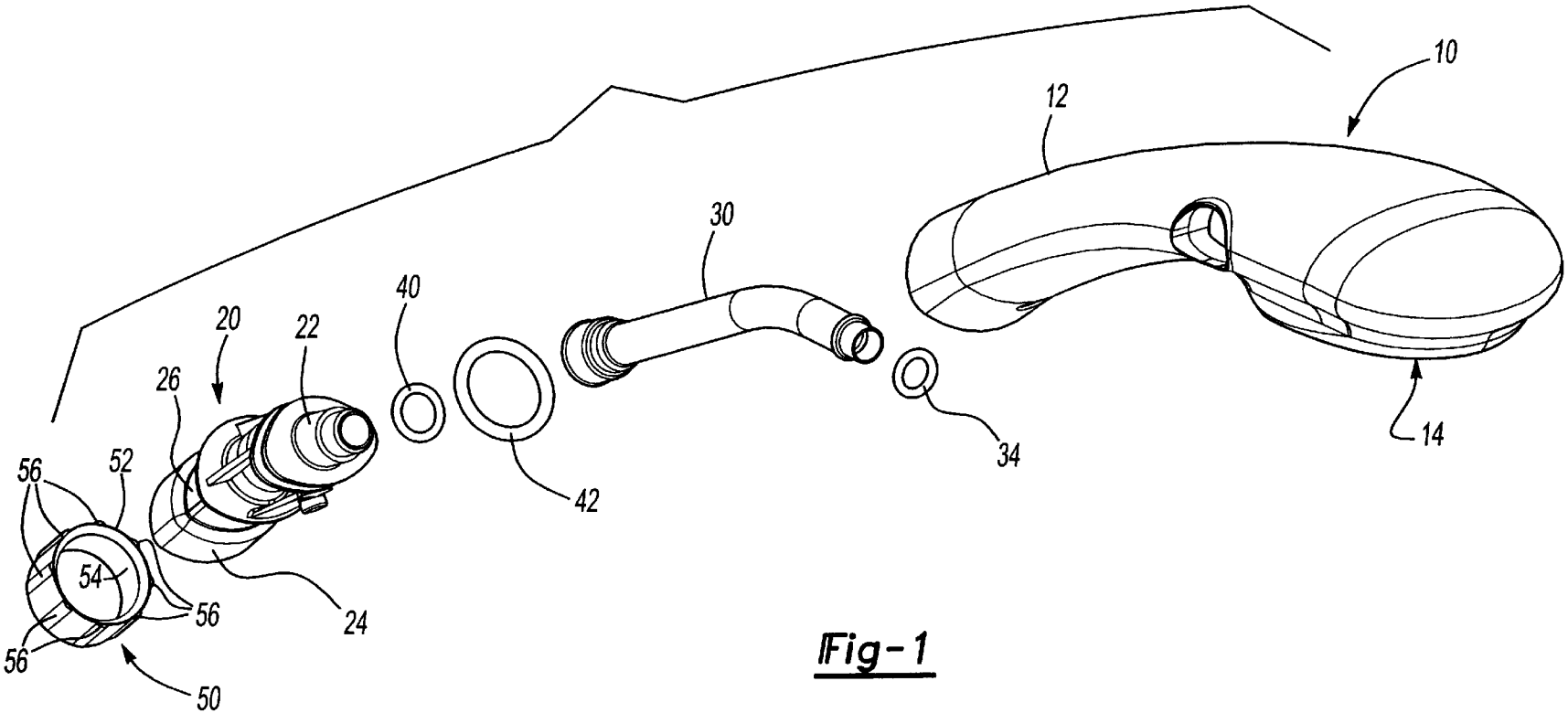
FIG. 1 is a simplified exploded perspective view showing the pull-out spray head, adapter and bushing of the instant invention.
Figure 2:
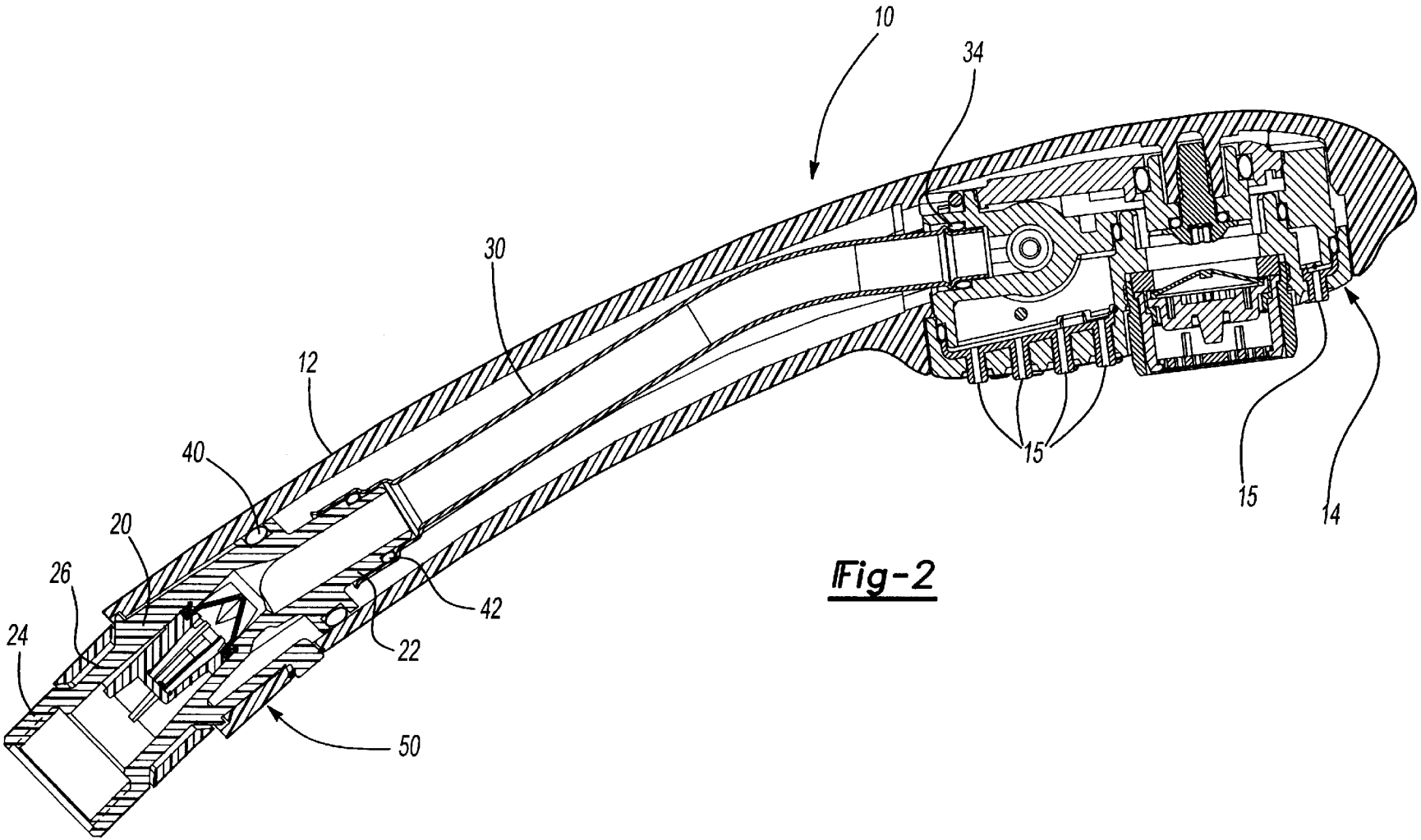
FIG. 2 is a side sectional view of the pull-out spray head.

The pull-out spray head includes a handle and a spray face 14 containing spray apertures. An adapter 20 is mounted in the handle 12 with a rear portion 22, as best illustrated in FIG. 2, extending rearwardly of and outside the handle. The adapter may be comprised of any suitable material, e.g., metal such as copper, brass, etc., or plastic. In one embodiment it is comprised of plastic. On the front end 26 of the adapter 20 is mounted a tube 30 carrying water to the spray face 14. A hose is connected to the end 24 of the adapter 20. The hose preferably comprises an elongated, flexible, tubular polymeric conduit surrounded by corrugated stainless steel shielding. It will be appreciated, however, that other types of hose construction such as, for example, fiber reinforced polymeric hoses and the like can be substituted for the preferred hose in the invention.

O-rings 40 and 42 are mounted on the adapter 20 as illustrated in FIG. 2, while O-ring 34 is mounted on the tube 30.

A groove 26 is formed around the outer circumference of adapter 20 in the rear portion 22 which extends rearwardly of and outside of handle 12. In one embodiment the groove 26 is substantially annular in shape. The groove 26 is sized to accept bushing 50.

In the preferred embodiment bushing 50 is substantially annular and has an outer face 52 and inner face 54. In the embodiment illustrated in the drawings the inner face 54 is generally smooth while the outer face 52 has raised sections or protuberances 56 thereon. In the embodiment illustrated in the drawings the raised sections are ribs 56. There are a plurality of ribs. These ribs extend axially and are circumferentially spaced apart.

Figure 4:
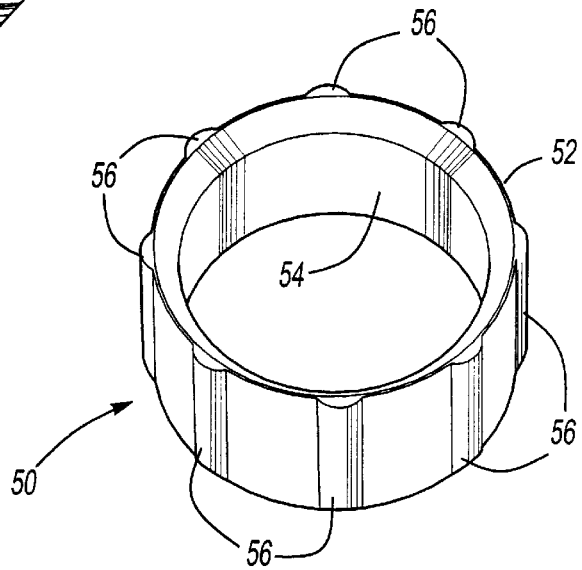
FIG. 4 is a perspective view of the bushing of the instant invention.
Figure 5:
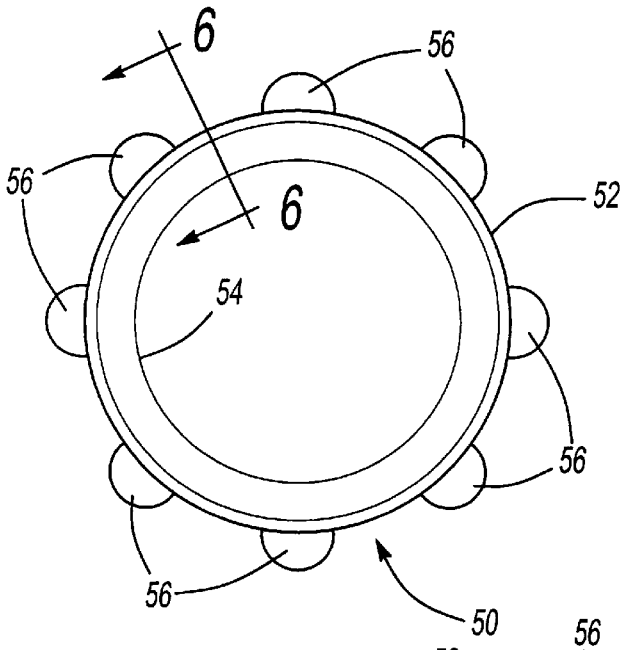
FIG. 5 is a front elevational view of the bushing.
Figure 6:
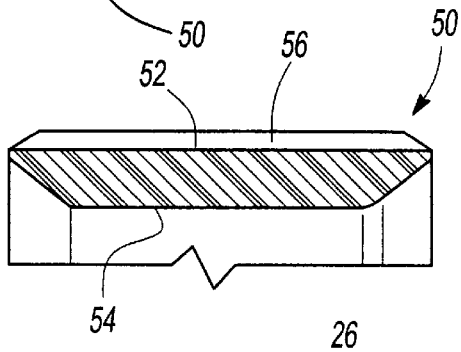
FIG. 6 is a partial side sectional view of the bushing showing the rib taken along lines 6—6 in FIG. 5.
Figure 7:
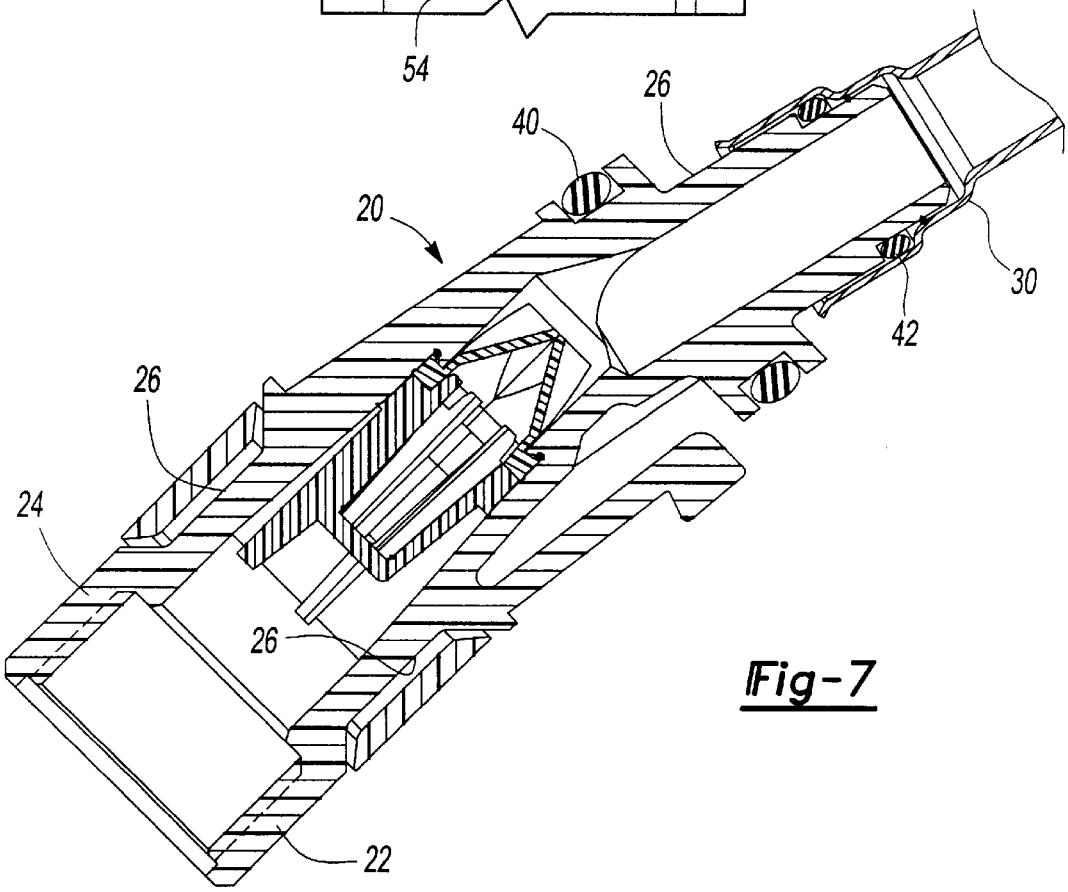
FIG. 7 is a partial side sectional view of the adapter showing the bushing mounted thereon.

In the embodiment illustrated in the figures, as best seen in FIGS. 4 and 5, the raised ribs are semicircular in cross-section.

Figure 3:
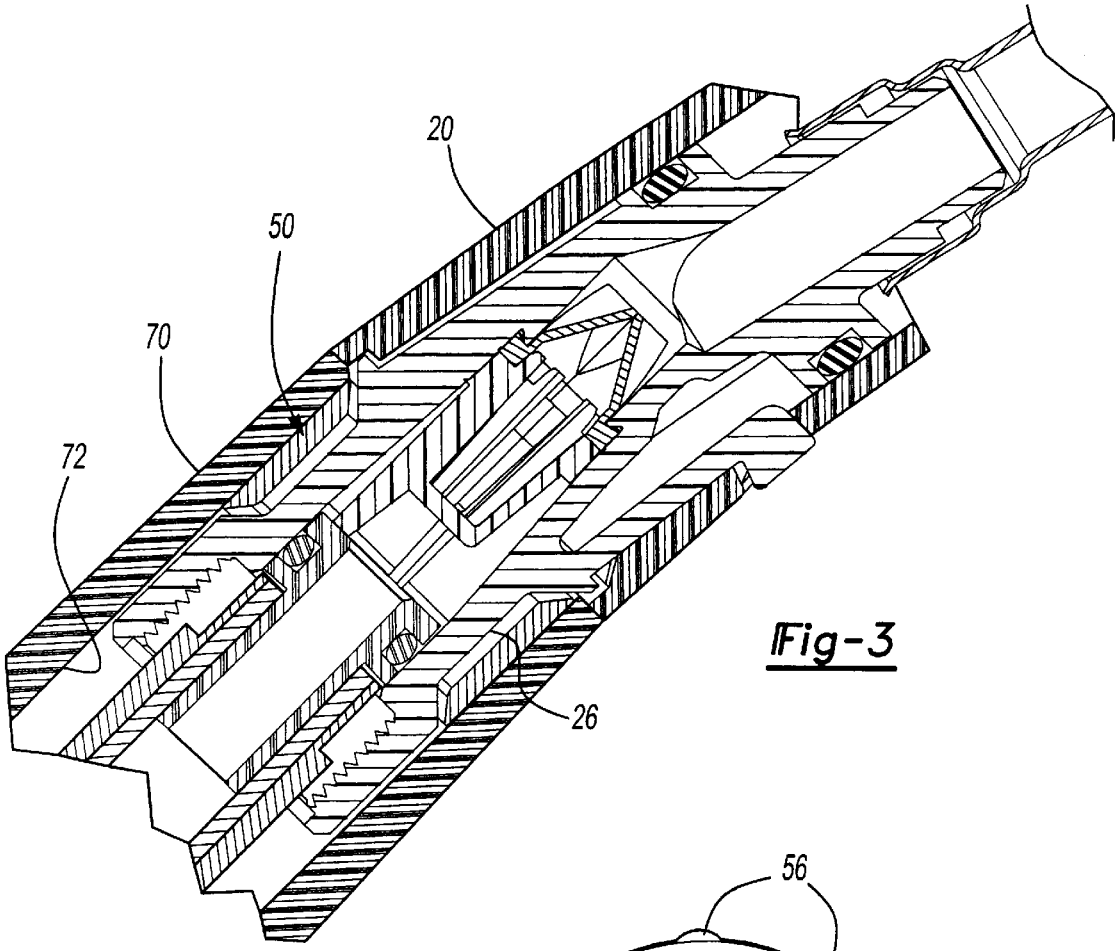
FIG. 3 is a partial side sectional view of the rear end of the pull-out spray head seated in the spout.

With the bushing 50 mounted on the adapter 20, more specifically disposed in the groove 26 in adapter 20, the pull-out spray head 10 is inserted into the hub 70. With the adapter 20 inserted into hub 70, as best illustrated in FIG. 3, the ribs 56 of the bushing 50 come into contact with the inner surface 72 of the hub 70, and by friction keep the adapter 20, and consequently the pull-out spray head 10 to which the adapter is secured, from wobbling.

While the invention has been described in detail with reference to a few selected embodiments, it should be recognized that the invention is not limited to those precise embodiments. Rather, many modifications and variations would present themselves to persons skilled in the art without departure from the scope and spirit of this invention as defined in the appended claims.

We claim:

1. In a pull-out spray head faucet comprising a spout and a pull-out spray head removably disposed in said spout, said pull-out spray head having a handle and a portion of an adapter extending rearwardly out of and beyond the handle of said pull-out spray head, the improvement comprising an elastomeric bushing being disposed on said portion of said adapter to frictionally engage said spout and retard wobble of said pull-out spray head when it is inserted into said spout, said elastomeric bushing having on its surface a plurality of axially extending and spaced apart from each other raised ribs.

2. The faucet of claim 1 wherein said elastomeric bushing is annular.

3. The faucet of claim 2 wherein said raised ribs are circumferentially spaced apart from each other.

4. The faucet of claim 2 wherein said bushing is comprised of rubber.

5. The faucet of claim 2 wherein said bushing is disposed in an annular groove in said portion of said adapter.

* * * * *